US010588368B2

(12) United States Patent
Flockton et al.

(10) Patent No.: US 10,588,368 B2
(45) Date of Patent: Mar. 17, 2020

(54) SHOULDER STRAPS FOR SPORTS GARMENTS

(71) Applicant: SPEEDO INTERNATIONAL LIMITED, London (GB)

(72) Inventors: Karen Flockton, London (GB); Ben Hardman, Finchley (GB); Tim Sharpe, Finchley (GB); Neil Irvine, Finchley (GB)

(73) Assignee: SPEEDO INTERNATIONAL LIMITED, Greater London (GB)

( * ) Notice: Subject to any disclaimer, the term of this patent is extended or adjusted under 35 U.S.C. 154(b) by 371 days.

(21) Appl. No.: 15/504,617

(22) PCT Filed: Aug. 14, 2015

(86) PCT No.: PCT/GB2015/052361
§ 371 (c)(1),
(2) Date: Feb. 16, 2017

(87) PCT Pub. No.: WO2016/027069
PCT Pub. Date: Feb. 25, 2016

(65) Prior Publication Data

US 2017/0238638 A1 Aug. 24, 2017

(30) Foreign Application Priority Data

Aug. 22, 2014 (GB) ..... 1414947.0

(51) Int. Cl.

| | |
|---|---|
| ***A41F 15/00*** | (2006.01) |
| ***A41D 31/02*** | (2019.01) |
| ***A41D 7/00*** | (2006.01) |

(52) U.S. Cl.
CPC ..... *A41F 15/00* (2013.01); *A41D 7/00* (2013.01); *A41D 31/02* (2013.01); *A41D 2500/52* (2013.01); *A41D 2600/10* (2013.01)

(58) Field of Classification Search
CPC ..... A41D 7/00; A41D 31/02; A41D 2500/52; A41D 2600/10; A41F 15/00; A41F 15/02
(Continued)

(56) References Cited

U.S. PATENT DOCUMENTS 1,687,592 A 10/1928 Rothstein
2,124,210 A * 7/1938 Prindle ..... B44F 9/12 2/338

(Continued)

FOREIGN PATENT DOCUMENTS

AU 769291 6/2001
CN 1372857 10/2002

(Continued)

OTHER PUBLICATIONS

Office Action from CNIPA in the corresponding Chinese Application No. 201580051107,1, dated Jul. 16, 2018.

(Continued)

*Primary Examiner* — Anne M Kozak
(74) *Attorney, Agent, or Firm* — Marvin Petry; Stites & Harbison, PLLC

(57) ABSTRACT

A sports garment comprising a pair of shoulder straps (2). Each shoulder strap has a multi-layer construction and at least one of the layers in the multi-layer construction has a plurality of holes formed therein. The holes are spaced from one another along the length of the strap.

6 Claims, 3 Drawing Sheets

(58) Field of Classification Search
USPC ..... 2/338; 450/86, 88
See application file for complete search history.

(56) References Cited

U.S. PATENT DOCUMENTS 2,203,822 A * 6/1940 Hyman ..... B65D 63/10 24/17 A
2,485,720 A * 10/1949 Elliott ..... A41F 15/007 2/336
2,511,483 A * 6/1950 Skirow ..... A41D 27/26 2/268
2,523,720 A * 9/1950 Riedler ..... A41D 27/26 2/268
2,535,018 A * 12/1950 Reid ..... A41D 7/00 2/67
2,616,093 A * 11/1952 Talalay ..... A41D 27/26 2/268
2,646,573 A * 7/1953 Morgenstern ..... A41D 1/14 2/268
2,699,550 A * 1/1955 Freid ..... A41F 15/007 2/107
3,013,919 A * 12/1961 Bialy ..... A41F 9/002 156/212
3,025,859 A * 3/1962 Rosenberg ..... A41F 15/00 2/460
3,616,148 A * 10/1971 Edelman ..... A41F 15/005 428/129
3,873,403 A * 3/1975 Edelman ..... A41F 15/005 428/111
4,100,924 A * 7/1978 Rosenberg ..... A41F 15/00 450/86
4,612,935 A * 9/1986 Greifer ..... A41F 15/007 2/268
4,638,513 A * 1/1987 Woods ..... A41F 15/005 2/268
4,795,400 A * 1/1989 Greenberg ..... A41F 15/007 2/268
5,155,869 A * 10/1992 Ralli ..... A41D 27/20 2/247
5,165,113 A * 11/1992 Hyams ..... A41F 15/00 2/338
5,240,538 A * 8/1993 Hyams ..... A41F 15/00 156/245
5,474,487 A * 12/1995 Roush ..... A41F 15/02 2/101
5,507,681 A * 4/1996 Smith ..... A41F 15/00 2/243.1
5,984,762 A * 11/1999 Tedeschi ..... A41F 15/00 2/243.1
6,048,253 A * 4/2000 Larsen ..... A41C 1/10 2/44
6,180,178 B1 1/2001 Vogt
6,186,861 B1 * 2/2001 Flaherty ..... A41C 3/00 450/1
6,381,752 B1 5/2002 Cartelli
6,634,923 B2 * 10/2003 Waitz ..... A41C 3/12 2/268
6,827,628 B2 * 12/2004 Kaye ..... A41F 15/005 2/268
6,837,771 B2 * 1/2005 Falla ..... A41B 17/00 2/400
7,395,553 B2 7/2008 O'Hara
7,927,179 B2 * 4/2011 Kaye ..... A41F 15/02 450/86
2002/0023709 A1 * 2/2002 Tedeschi ..... A41F 15/007 156/213
2002/0111119 A1 * 8/2002 Johnson ..... A41F 15/005 450/86
2004/0259469 A1 * 12/2004 Cano ..... A41F 15/007 450/86
2005/0097658 A1 * 5/2005 Lyons ..... A41F 15/007 2/267
2005/0106972 A1 5/2005 Lam et al.
2006/0168711 A1 * 8/2006 Jaw ..... A01K 27/006 2/338
2006/0183850 A1 8/2006 Liu et al.
2006/0277645 A1 12/2006 Okajima
2007/0012397 A1 * 1/2007 de Jong ..... A62B 17/005 156/252
2007/0021034 A2 * 1/2007 Barbour ..... A41C 3/0057 450/1
2007/0022510 A1 * 2/2007 Chapuis ..... A41D 13/0015 2/69
2008/0060745 A1 * 3/2008 Lau ..... A41F 15/005 156/182
2008/0139084 A1 6/2008 Kelley et al.
2008/0153388 A1 * 6/2008 Liu ..... A41C 3/00 450/39
2008/0280532 A1 11/2008 Simpson
2009/0098803 A1 * 4/2009 Reinisch ..... A41C 3/0057 450/39
2014/0090142 A1 4/2014 Waller et al.
2015/0223525 A1 * 8/2015 Miller ..... A41C 3/0057 450/65

FOREIGN PATENT DOCUMENTS

| | | |
|---|---|---|
| CN | 201733900 | 2/2011 |
| CN | 203137150 | 8/2013 |
| CN | 103637421 | 12/2013 |
| CN | 103689818 | 4/2014 |
| FR | 1 287 613 | 3/1962 |
| FR | 2948695 | 2/2011 |
| JP | 3067617 | 1/2000 |
| JP | 3082567 | 9/2001 |
| JP | 2002138303 | 5/2002 |
| JP | 3139029 | 1/2008 |
| WO | WO 01/93710 | 12/2001 |
| WO | WO 03/003862 | 1/2003 |

OTHER PUBLICATIONS

Great Britain Search Report, Application No. GB1414947.0, dated Feb. 20, 2015, 2 pages.
International Search Report for PCT/GB2015/052361, dated Jan. 7, 2016.
Written Opinion of the International Searching Authority for PCT/GB2015/052361, dated Jan. 7, 0216.
Notification of Transmittal of the International Search Report and the Written Opinion of the International Searching Authority, or the Declaration for PCT/GB2015/052361, dated Jan. 7, 2016.
Japanese Office Action, Application No. 2017-510642, dated: May 7, 2019.
Chinese Office Action, Chinese Patent Application No. 2015800511071, dated Feb. 1, 2019, 18 pages.

* cited by examiner

SHOULDER STRAPS FOR SPORTS GARMENTS

TECHNICAL FIELD

The present invention relates generally to shoulder straps for garments, especially (although not exclusively) suited to sports garments. Particular examples are described in relation to swimsuits, which is a preferred use. However, the concepts can be applied to other sports and athletic garments including, for example, water polo and triathlon wear.

BACKGROUND

Athletes, including swimmers, typically wear tight fitting garments which help decrease air/water resistance, which is especially important in competitive events. Many styles of sports garments, including swimsuits, include shoulder straps that pass over the athletes shoulders when the garments is worn to help locate and hold the garment in place on the athletes body.

A conventional shoulder strap construction for sports garments includes an elastic strap element around which a textile (usually the same textile used for the body of the garment) is wrapped to completely enclose the elastic strap element. The textile and elastic are typically stitched to secure this composite structure together.

Straps having this conventional construction are typically quite bulky and are prone to twisting, buckling and curling when in position over an athlete's shoulder. This can lead to pinching, discomfort and sometimes visible markings on the skin. The modulus of elasticity that can be achieved for straps of this construction is limited, the straps therefore having a relatively high degree of stretch. This can lead to excessive stretching of the strap during athletic motion (e.g. swimming), which in turn can lead to movement of the strap across the skin that can cause chaffing. A higher modulus of elasticity could be achieved by using a stronger elastic but this would undesirably restrict the athlete's freedom of movement and would also exacerbate the pinching and discomfort caused by the strap as it is pulled more tightly against the skin.

SUMMARY OF THE INVENTION

It is a general aim of embodiments of the present invention to offer a relatively thin, flat strap with relatively high lateral stiffness and a relatively high modulus of elasticity that can vary along the length of the strap.

In one aspect, the invention provides a sports garment comprising a pair of shoulder straps, wherein each shoulder strap has a multi-layer construction, wherein at least one of the layers has a plurality of holes formed therein, the holes being spaced from one another along the length of the strap.

In some embodiments the size of holes varies along the length of the strap in order to provide a variation in the elastic modulus of the strap along its length. In other embodiments the spacing of said holes from one another varies along the length of the strap to give this variation in elastic modulus. In further embodiments both the size and the spacing of the holes may vary along the length of the strap to give this variation in elastic modulus. Generally speaking holes that are larger or more closely spaced will result in a lower modulus of elasticity (i.e. greater stretch).

In some embodiments, the holes may have a maximum dimension across the hole (e.g. diameter in the case where the holes are circular, length of the longest side in the case where the holes are rectangular, etc) between 2 mm and 18 mm. That is, the smallest holes may have a maximum dimension of 2 mm and the largest holes a maximum dimension of 18 mm. In other embodiments, the maximum dimension of the largest holes may be greater, for example 20 mm, 25 mm, 30 mm or more.

The largest dimension of the hole may extend across the width of the strap, along the length of the strap, or at an angle to the width of the strap. Preferably the ends of the hole are spaced at least 2 mm from the side edges of the strap and more preferably at least 3 mm from the side edges of the strap. For example, in the case where the strap width is 25 mm (which is typical), and the longest dimension of the hole extends across the width of the strap, the longest dimension is preferably no more than 18 mm.

In some embodiments the spacing of the holes along the strap is between 5 mm and 20 mm, between 5 mm and 10 mm, or between 5 mm and 6 mm. "Spacing" refers to distance between a line extending width-wise across the strap through the centre of one hole to a line extending width-wise across the strap through the centre of the adjacent hole.

By providing an elastic modulus that varies along the length of the strap, rather than the uniform modulus of conventional strap constructions, it becomes possible to allow greater stretch in portions of the strap where the athlete needs more freedom of movement, whilst restricting stretch in other portions of the strap to give greater support and minimise movement of the strap to minimise or avoid chaffing.

In embodiments of this aspect of the invention, the holes can be formed in any of the layers of the multi-layer strap. In strap constructions in which the layers are formed of materials that have different elastic modulus from one another, the holes are preferably formed in a layer having the highest elastic modulus as the inclusion of the holes will then have a greater effect (reduction) on the overall elastic modulus of the strap.

In some embodiments, the holes are in the top layer of the multi-layer strap construction. As well as enabling a variation in elastic modulus along the strap, by having the holes in the top layer, an underlying layer can be exposed, which depending on the nature of the exposed layer, may have performance and/or aesthetic benefits.

In some embodiments, at least one of the layers is an elastomeric substrate (e.g. elastomeric film), such as a polyurethane (PU) laminate. The material of the elastomeric substrate (e.g. PU) may be selected to provide a barrier to water ingress and, as one of the layers in the structure, contributes to the lateral rigidity of the strap to resist buckling and twisting.

In another aspect, the invention provides a sports garment comprising a pair of shoulder straps, wherein each shoulder strap has a multi-layer construction and at least one of the layers is a polyurethane (PU) laminate.

In some embodiments of either aspect of the invention, holes are formed in a top layer of the multi-layer strap and the polyurethane laminate is below the top layer so that it is visible through the holes in the top layer. By exposing the PU laminate on a top surface of the strap it can provide a lower friction area compared with textiles normally used for athletic garments. The PU laminate can also provide aesthetic detailing to the strap, visible through the openings in the top layer. The top layer, which may be a textile layer (for example formed from the same textile as the main body of the garment), may be secured to the PU layer with a glue layer. In this case, the glue layer may also include holes in register with the holes in the top layer, to ensure that the PU layer is exposed through the holes.

In some embodiments the strap has a construction comprising at least five layers, which may be, in order, a first textile layer, a first glue layer, a polyurethane laminate layer, a second glue layer and a second textile layer.

In some embodiments, the strap has a construction comprising at least eight layers, which may be a first textile layer, a first glue layer, a polyurethane laminate layer, a second textile layer, a second glue layer, a third textile layer, a third glue layer and a fourth textile layer. The first textile layer and first glue layer may be wider than the other layers so that opposite sides of these layers can wrap around the side edges of the PU laminate layer, second textile layer, second glue layer and third textile layer and underneath the third textile layer. The third glue layer then adheres the fourth textile layer to portions of the first textile layer that wrap underneath the third textile layer. Opposite side edges of the first textile layer and first glue layer that wrap underneath the third textile layer may be spaced from one another so they do not fully cover the underside of the third textile layer. The third glue layer can then also adhere the fourth textile layer to the uncovered portion of the third textile layer.

The textile layers will typically be a woven or knitted elasticated fabric and may be the same fabric that is used for other portions of the garment or the complete garment. The textile is preferably a resilient stretch fabric, with the textile layers in the structure contributing to the overall elastic modulus (the textile layers may be the biggest contributor to the elastic modulus).

Some embodiments may employ a nylon/elastane woven fabric, with a relatively high elastane content (e.g. above 35%). This fabric is particular suited for swimsuits intended for elite athletes. Other embodiments may use a polyester fabric or other polymer fabrics (e.g. polypropylene), or even metallic or carbon fibres.

In some embodiments the textile will have a water repellent finish, especially for swimsuits, to help prevent the textile from taking on water and increasing mass.

The main purpose of the glue layers is to hold together the layered structure of the strap. However, appropriately selected glues can also contribute to the elastic modulus of the overall strap construction through inherent elastic properties of the glue. For example, the glue may be an ester polyurethane adhesive. The layers of glue within the strap construction may all have the same thickness, modulus and melt temperature as each other. Other embodiments could include varying thicknesses of glue, with corresponding variations in modulus. The glues can also have varying melt temperatures (the temperature at which the bonding process occurs).

DETAILED DESCRIPTION

The invention will now be further described with reference to the following non-limiting Figures and Examples. Other embodiments of the invention will occur to those skilled in the art in the light of these.

Figure 1:
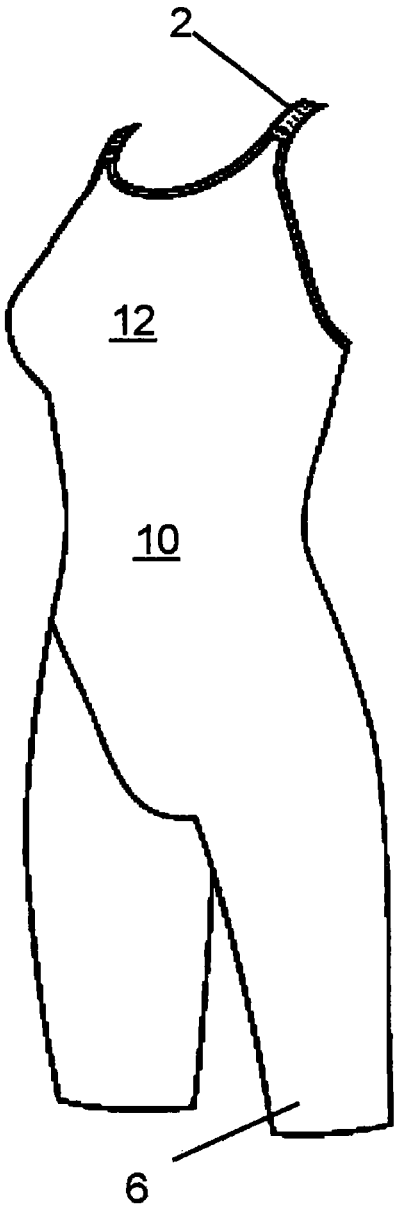
FIG. 1 shows a front perspective view of a swimsuit in accordance with an embodiment of the present invention.
Figure 2:
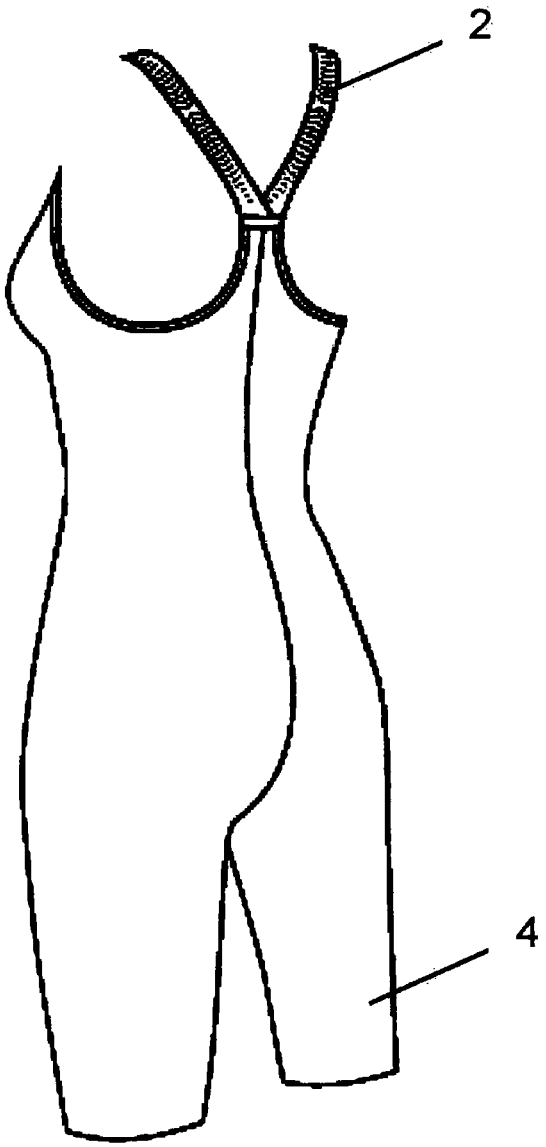
FIG. 2 shows a rear perspective view of the swimsuit of FIG. 1.

Referring to FIGS. 1 and 2, one example of a swimsuit that incorporates straps 2 in accordance with an embodiment of the invention is described. The swimsuit is a female suit intended for competitive swimming and is formed from an elasticated stretch fabric of a type known for use in competition swimsuits. In this example, the swimsuit is of a 'closed back kneeskin' type. As such, the suit includes left and right leg portions 4, 6 that extend down to the swimmer's knees and cover their thighs, a torso portion 10 that covers the abdomen and the back (extending up to the bottom of the scapula) and a chest portion 12 that covers the swimmer's chest. The suit has shoulder straps 2 that extend from the top of the chest portion 12, at spaced apart points on each shoulder, over the shoulder to a central point at the top of the back portion, between the scapula.

Figure 3:
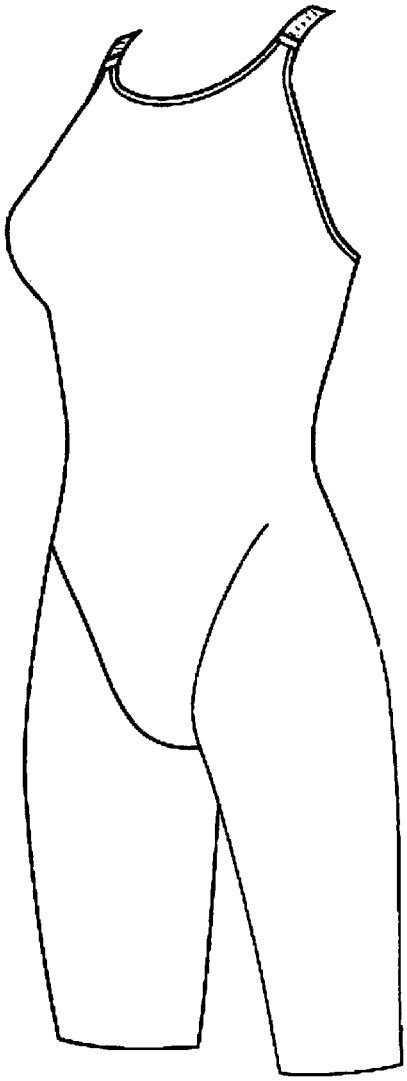
FIG. 3 shows a front perspective view of another swimsuit in accordance with an embodiment of the present invention.
Figure 4:
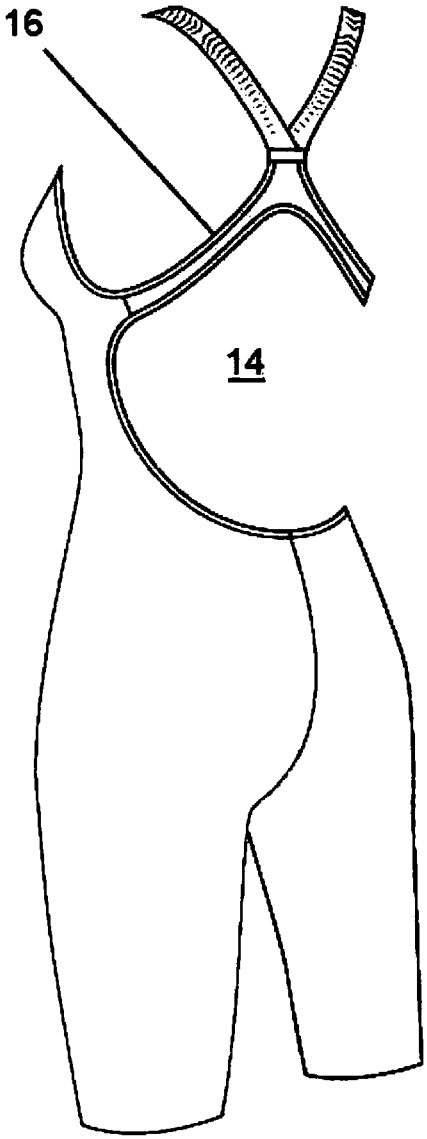
FIG. 4 shows a rear perspective view of the swimsuit of FIG. 3.

Turning to FIGS. 3 and 4, a second exemplary swimsuit incorporating straps 2 in accordance with an embodiment of the invention is shown. The suit of this example is very similar to the suit of FIGS. 1 and 2, save that in this example, the swimsuit is of an 'open back kneeskin' type. As such, it has an open back region 14 (i.e. a region free of fabric) above the top of the glutes. The rear of the shoulder straps 2 has a cross-like form with strap portions 16 extending laterally and downwardly from the centre of the back between the scapula to join with the side of the chest portion 12 of the suit.

Figure 5:
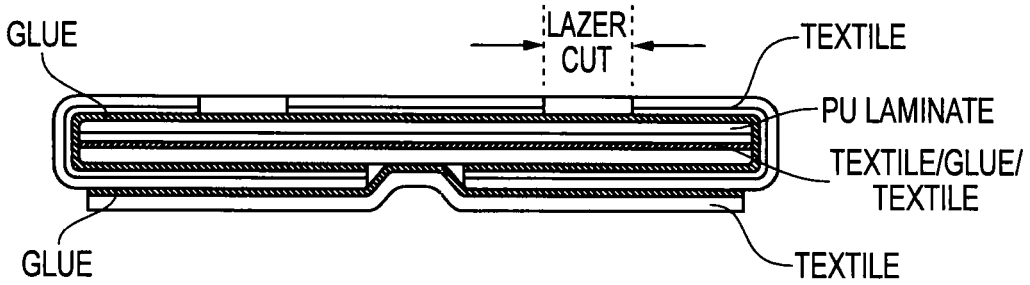
FIG. 5 shows, on an enlarged scale, a cross-section through a shoulder strap of the swimsuits of FIGS. 1 to 4.
Figure 6:
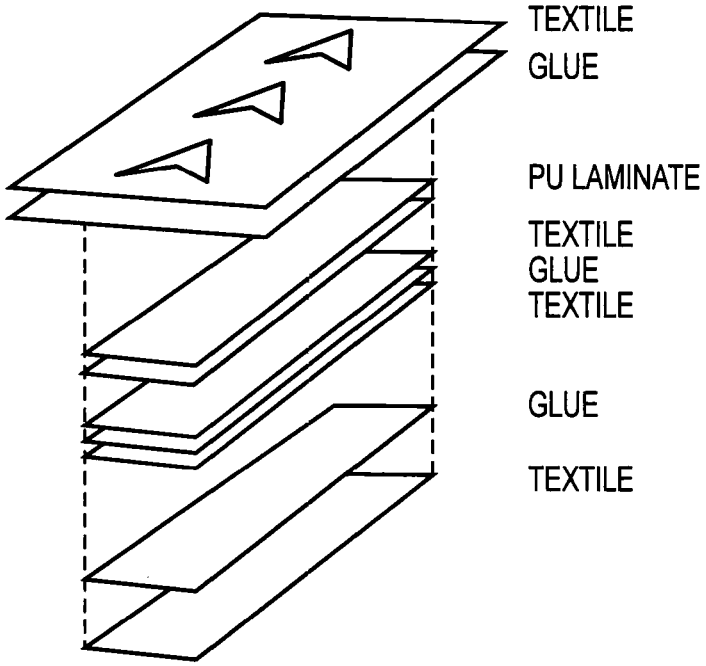
FIG. 6 shows an exploded view of a section of the strap of FIG. 5.

FIGS. 5 and 6 show the construction of the strap that is used in the swimsuit of FIGS. 1 and 2 as well as in the swimsuit of FIGS. 3 and 4.

As best seen in FIG. 6, the strap is formed from eight layers, which from top to bottom are:

1. A first textile layer;
2. A first glue layer;
3. A PU laminate layer;
4. A second textile layer;
5. A second glue layer;
6. A third textile layer;
7. A third glue layer; and
8. A fourth textile layer.

In this example, the textile is 65% PA 35% Elastane. The glue is ester polyurethane. The laminate is a polyurethane film.

The second glue layer bonds together the second and third textile layers. The first textile layer is wider than the second and third textile layers and PU laminate layer so that, as best seen in FIG. 5, it can wrap around the edges of these layers to sandwich them together, with the first glue layer bonding the first textile layer to the top of the PU laminate layer and to the bottom of the third textile layer. The fourth textile layer is bonded to the underside of the sandwich structure, with a majority of this layer being bonded to the first textile layer where it wraps underneath the third textile layer, save for a central section, between opposite edges of the first textile layer, where the fourth textile layer is bonded to the underside of the third textile layer. This construction, as best seen in FIG. 5, can provide a channel on the underside of the strap, running longitudinally along a centre line of the strap. This may help to hold the strap in place on the wearer's shoulder as their skin keys into the channel, helping to prevent lateral slip. It may also help to resist curling of the strap.

The first fabric layer on the top surface of the strap has formed in it a series of holes that are arranged in a longitudinal array along the length direction of the strap. The holes may have different spacings between them and/or be of different sizes to vary the stretch characteristics of the strap along its length. Regions of the strap with larger or more densely packed holes with have a lower modulus of elasticity (i.e. are more susceptible to stretch).

As best seen in FIG. 5, the first glue layer has holes corresponding to those in the first fabric layer, so that the top surface of the PU laminate layer is exposed through the holes.

The layered structure of the strap can be formed, for example, using a high temperature process to bond the layers together. Pressure is also applied to compress the layers of the strap and form a thin structure, which may for example be 1.2 mm thick or less (e.g. 1 mm thick or less).

The holes in the top layer of the strap can be formed by a laser cutting process.

The skilled person will appreciate that the swimsuits illustrated in the Figures and described above are examples embodying inventive concepts described herein and that many and various modifications can be made without departing from the invention. For example, the same concepts can be applied to other styles of swimsuit (for example, body suits for men, suits that have full-length legs and/or arms, etc) and to other types of sports garment, such as triathlon suits and waterpolo suits for example.

The invention claimed is:

1. A sports garment comprising a pair of shoulder straps, wherein each shoulder strap has a multi-layer construction, and at least one of the layers in each multi-layer construction has a plurality of holes formed by removing portions of the at least one of the layers, the holes being spaced from one another along the length of each strap, wherein the multi-layer construction of each strap has a construction comprising at least eight layers, and wherein the at least eight layers include, in sequence, a first textile layer, a first glue layer, a polyurethane laminate layer, a second textile layer, a second glue layer, a third textile layer, a third glue layer and a fourth textile layer.

2. A sports garment according to claim 1, wherein the size of said holes varies along the length of each strap.

3. A sports garment according to claim 1, wherein the spacing of said holes from one another varies along the length of each strap.

4. A sports garment according to claim 1, wherein the holes are formed in the first textile layer of each multi-layer strap.

5. A sports garment according to claim 1, wherein the first textile layer and first glue layer are wider than the other said layers and wherein opposite sides of the first textile layer and first glue layer wrap around the side edges of the polyurethane laminate layer, second textile layer, second glue layer and third textile layer and underneath the third textile layer, the third glue layer adhering the fourth textile layer to portions of the first textile layer that wrap underneath the third textile layer.

6. A sports garment according to claim 5, wherein opposite side edges of the first textile layer and first glue layer that wrap underneath the third textile layer are spaced from one another so they do not fully cover the underside of the third textile layer, wherein the third glue layer also adheres the fourth textile layer to an uncovered portion of the underside of the third textile layer.

* * * * *